US010118309B2

(12) United States Patent
Bowman et al.

(10) Patent No.: US 10,118,309 B2
(45) Date of Patent: Nov. 6, 2018

(54) LOG SPLITTER WITH EXTENDABLE WORK SPACE

(71) Applicant: Blount, Inc., Portland, OR (US)

(72) Inventors: Ron Bowman, Golden, CO (US); Jason Carlson, Bryon, IL (US); Patrick Foley, Golden, CO (US); Emanuel Guzman, Lakewood, CO (US); John Hatch, Ann Arbor, MI (US); Hovan Huang, Lakewood, CO (US); Marilena Papaianache, Littleton, CO (US); Randy Pitzer, Dixon, IL (US)

(73) Assignee: Blount, Inc., Portland, OR (US)

( * ) Notice: Subject to any disclaimer, the term of this patent is extended or adjusted under 35 U.S.C. 154(b) by 226 days.

(21) Appl. No.: 15/048,966

(22) Filed: Feb. 19, 2016

(65) Prior Publication Data

US 2016/0257023 A1 Sep. 8, 2016

Related U.S. Application Data

(60) Provisional application No. 62/213,496, filed on Sep. 2, 2015, provisional application No. 62/127,785, filed on Mar. 3, 2015.

(51) Int. Cl.
*B27L 7/00* (2006.01)

(52) U.S. Cl.
CPC ..... *B27L 7/00* (2013.01)

(58) Field of Classification Search
CPC ..... B27L 7/00; B27L 7/06; B27L 7/08
See application file for complete search history.

(56) References Cited

U.S. PATENT DOCUMENTS

| | | | | |
|---|---|---|---|---|
| 4,157,105 | A | 6/1979 | Gansley | |
| 4,164,965 | A | 8/1979 | Bodart | |
| 4,432,402 | A | 2/1984 | Wirsbinski | |
| 4,782,870 | A * | 11/1988 | Duerr | B27L 7/00 144/193.1 |
| 7,814,945 | B2 | 10/2010 | Babcock | |
| 8,511,354 | B2 * | 8/2013 | Schamberger | B27L 7/00 144/193.2 |
| 9,381,668 | B2 * | 7/2016 | Banjo | B27L 7/00 |
| 2013/0098503 | A1 * | 4/2013 | Shaeffer | B27L 7/00 144/195.1 |

FOREIGN PATENT DOCUMENTS

| | | | |
|---|---|---|---|
| CA | 2850939 | A1 | 11/2014 |
| DE | 102012200587 | A1 | 7/2013 |

* cited by examiner

*Primary Examiner* — Matthew G Katcoff
(74) *Attorney, Agent, or Firm* — Schwabe Williamson & Wyatt, P.C.

(57) ABSTRACT

Embodiments provide a log splitter with an extendable, or otherwise movable, work zone to increase the accessibility of the work zone for a user and improve movability of the log splitter. The log splitter may be configurable to be in an extended position, a compact position, a vertical position, or a moving position. In the extended position, the log splitter may split logs in a horizontal direction, and in the vertical position the log splitter may split logs in a vertical direction. When the log splitter is in the moving position and/or the compact position an operator of the log splitter may manually move the log splitter to a new position and/or location, or tow the log splitter with a vehicle.

3 Claims, 12 Drawing Sheets

LOG SPLITTER WITH EXTENDABLE WORK SPACE

RELATED APPLICATIONS

The present application claims priority to U.S. Provisional Patent Application No. 62/127,785 filed on Mar. 3, 2015 and U.S. Provisional Patent Application No. 62/213,496 filed on Sep. 2, 2015, the disclosures of which are hereby incorporated by reference in their entirety.

TECHNICAL FIELD

Embodiments herein relate to the field of log splitters, and, more specifically, to a log splitter with an extendable work zone.

BACKGROUND

A log splitter is a relatively large piece of equipment used to split logs or pre-cut sections (also referred to as "rounds") of wood into smaller pieces for various uses, such as for firewood and/or to enable easier transport of the logs or wood. Most log splitters occupy a relatively significant footprint, and can be cumbersome to navigate and/or move around due to the location of certain features and/or components of the splitter, such as the wheels, engine, fuel tanks, a base of the log splitter, and other like components.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

FIGS. 1A-1 C illustrate a log splitter with an extendable work zone, wherein FIG. 1A shows the log splitter in a compact position in accordance with various embodiments.

DETAILED DESCRIPTION OF DISCLOSED EMBODIMENTS

Figure 1A:
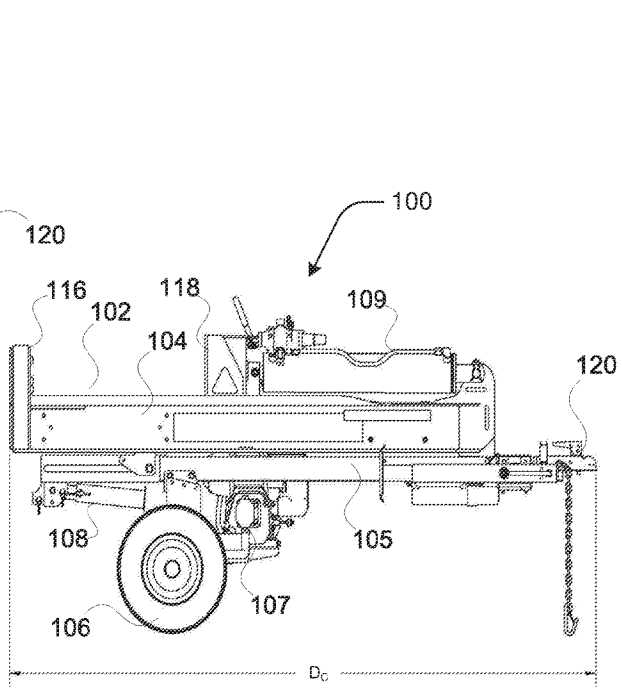

In the following detailed description, reference is made to the accompanying drawings that form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense.

Various operations may be described as multiple discrete operations in turn, in a manner that may be helpful in understanding embodiments; however, the order of description should not be construed to imply that these operations are order-dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form at least one of A, B, and C" means (A), (B), (C), (A and B), (A and C), (B and C), or (A, B and C). For the purposes of the description, a phrase in the form "(A)B" means (B) or (AB); that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Embodiments herein provide a log splitter (also referred to as a "splitter") with an extendable, or otherwise movable, work space to increase the accessibility of the work space for a user of the log splitter.

In embodiments, a bracket may be welded to a tongue of the splitter enabling the user to slide the beam back, from an otherwise compact position, creating a larger operating or work zone. The configuration allows users to split logs in both a horizontal (with the beam in a compact or extended position) and a vertical position. In embodiments, a splitter is provided with a sliding beam. In embodiments, a splitter having an extendable work zone is configured to be functional in both horizontal and vertical splitting positions. In an embodiment, a splitter may have a height adjustable stand. In embodiments, a splitter may include an automatically deployable and automatically retractable stabilization leg. In an embodiment, the stabilization leg may deploy as the log splitter transitions from a compact position to an extended work zone position or configuration. In an embodiment, the stabilization leg may retract as the splitter transitions from the extended position to the compact position. In an embodiment, another stabilization leg may extend a footplate for vertical splitting. Such a stabilization leg may also operate as a flag for towing. Example embodiments also provide alternative construction for an extended work zone and/or a reverse beam of a log splitter.

Figure 1B:
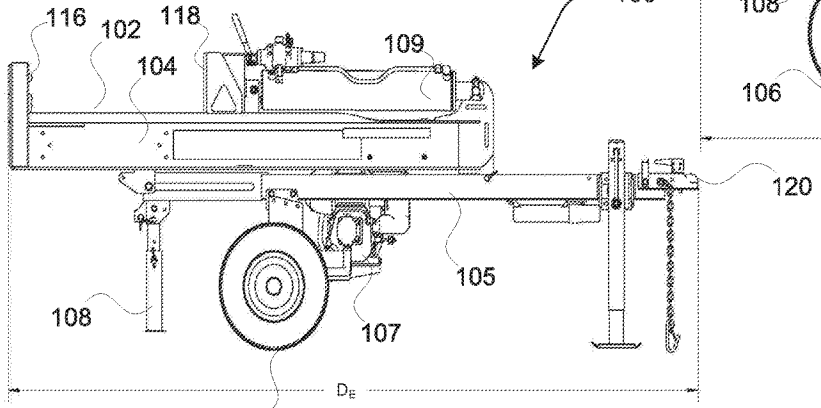
FIG. 1B shows the log splitter in an extended to enhance the accessibility of the work zone in accordance with various embodiments.
Figure 1C:
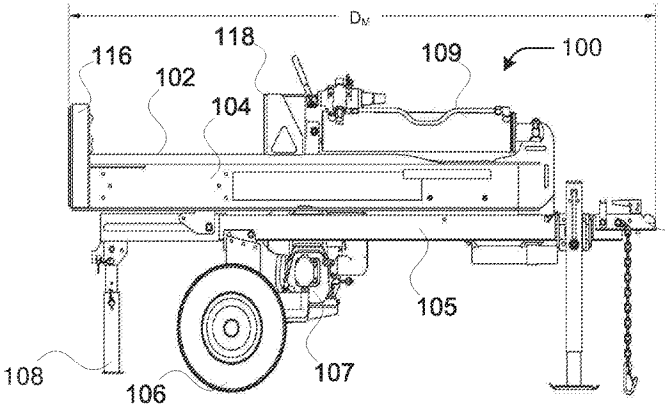
FIG. 1C illustrates the log splitter in a moving or towing position in accordance with various embodiments.

FIGS. 1A-C illustrate a log splitter 100 (also referred to as "splitter 100") with an extendable work zone 102, wherein FIG. 1A shows the splitter 100 in a compact position, FIG. 1B shows the splitter 100 in the extended position (also referred to as a "splitting configuration," a "work zone configuration," an "extended splitting configuration," and the like), and FIG. 1C shows the splitter 100 in a moving position. As shown, the splitter 100 includes a work zone 102 including a splitting device 118 and footplate 116, a beam 104, tongue 105, wheels 106, an engine 107, support 108 (also referred to as "stabilization leg 108," "stabilizer leg 108," and the like), moving mechanism 109, and hitch 120. The splitter 100 may also include a chassis, frame, or other like structure to which the various components of the splitter 100 may be affixed or attached.

The splitter 100 may be used to split logs or rounds of wood. During operation, the splitter 100 may drive splitting device 118 into a log held in the work zone 102 (not shown). The splitting device 118 may have a wedge shape or any other suitable shape. In the embodiment shown by FIGS. 1A-1C, the splitting device 118 may be moved towards the footplate 116 using a moving mechanism 109, thereby forcing the splitting device 118 into a log in the work zone 102. In other embodiments, the footplate 116 may be coupled with the moving mechanism and the footplate 116 may push the log onto the splitting device 118 (not shown by FIGS. 1A-1C). In such embodiments, the footplate 116 may be referred to as a "push plate." An example of such a configuration is shown and described with regard to FIG. 8.

The moving mechanism 109 may be a cylinder, such as a hydraulic cylinder, pneumatic cylinder, or the like. In embodiments where the moving mechanism 109 is a hydraulic cylinder, the engine 107 may include an electric motor that may drive a hydraulic pump. The hydraulic pump may pressurize the hydraulic cylinder using hydraulic fluid, and the pressurization of the hydraulic cylinder may move a piston coupled with the splitting device 118. In such embodiments, the splitter 100 may also include a tank to hold the hydraulic fluid (not shown). In embodiments where the moving mechanism 109 is a pneumatic cylinder, the engine 107 may include an electric motor that may drive a pneumatic pump and/or an air compressor to pressurize the pneumatic cylinder using air or another gas, and the pressurization of the pneumatic cylinder may move a piston coupled with the splitting device 118. In such embodiments, the splitter 100 may also include a tank to hold the gas (not shown). The engine 107 may be a gasoline engine, a diesel engine, an electric engine, or any other suitable engine.

In accordance with various embodiments, the splitter 100 may be configurable to be in an extended position (FIG. 1B), a compact position (FIG. 1A), or a moving position (FIG. 1C). In this regard, movement of the beam 104 with respect to the tongue 105 may increase or decrease an overall longitudinal length of the splitter 100. For example, the splitter 100 in the compact position (FIG. 1A) may have an overall longitudinal length $D_c$ as measured from the hitch 120 to the footplate 116, which may be smaller than the overall longitudinal length $D_e$ of the splitter 100 in the extended position. In this way, an operator may extend the work zone 102 away from the other components of the splitter 100 to enhance accessibility of the work zone 102.

Furthermore, a transition from the extended position to the compact position, and vice versa, may take place when the beam 104 is moved horizontally with respect to the tongue 105, the wheels 106, and/or the chassis of the splitter 100. For example, the splitter 100 may undergo a first transition from the extended position (FIG. 1B) to the compact position (FIG. 1A) and/or the moving position (FIG. 1C) by moving the beam 104 in a first direction with respect to the tongue 105, the wheels 106, and/or the chassis. The movement in the first direction may include sliding the beam 104 over the tongue 105 towards the hitch 120. Additionally, the splitter 100 may undergo a second transition from the compact position (FIG. 1A) and/or the moving position (FIG. 1C) to the extended position (FIG. 1B) by moving the beam 104 in a second direction with respect to the tongue 105, the wheels 106, and/or the chassis. The movement in the second direction may include sliding the beam 104 over the tongue 105 away from the hitch 120.

In some embodiments, an operator of the splitter 100 may manually move the splitter 100 to a new position and/or location when the splitter 100 is in the compact position. This is because, when the splitter 100 is in the compact position, the weight and/or center of gravity of the splitter 100 may be closer to the hitch 120 than the footplate 116. In this way, the splitter 100 in the compact position may have an advantageous weight distribution that may improve balance and stability of the splitter 100, which may improve a user's ability to manually move the splitter 100. In embodiments, the operator of the splitter 100 may manually move the splitter 100 with the stabilization leg 108 extended or retracted. Furthermore, an operator of the splitter 100 may be able to perform a log splitting operation while the splitter 100 is in the extended position, the moving position, or the compact position. As is evident from FIG. 1B, the work zone 102 portion of beam 104 may be more accessible in the extended position, limiting potential obstruction by the wheels 106 and/or stabilization leg 108. While the work zone 102 portion of beam 104 may be more accessible in the extended position, an operator of the splitter 100 may still perform a log splitting operation when the splitter 100 is in the compact position and/or the moving position.

As shown by FIGS. 1B-1C, the stabilization leg 108 may stabilize the splitter 100 when the splitter 100 is in the extended position or the moving position. For example, the stabilization leg 108 may keep the splitter 100 from tipping over when a relatively heavy log is placed on the work zone 102. As shown by FIGS. 1B-1C, the stabilization leg 108 is at a right angle with respect to the tongue 105. However, in other embodiments, the stabilization leg 108 may be at an obtuse angle with respect to the tongue 105. In various embodiments, the stabilization leg 108 may automatically deploy when the splitter 100 transitions from the compact position (FIG. 1A) to the moving position (FIG. 1C) and/or the extended position (FIG. 1B). Additionally, in various embodiments, the stabilization leg 108 may automatically retract when the splitter 100 transitions from the extended position (FIG. 1B) to the compact position (FIG. 1A). In some embodiments, movement of a sliding mechanism may initiate deployment/retraction of the stabilization leg 108. For example, such a sliding mechanism may allow the beam 104 to transition to/from the extended position to the moving position and/or the compact position. As a beam 104 slides into the extended position, for example, the stabilization leg 108 may deploy. In some embodiments, a portion of the sliding action (for example, the last few inches of the sliding action) of the beam 104 may push the sliding mechanism to initiate the lowering of the stabilization leg 108 into the deployed position. The sliding mechanism may also initiate the retraction of the stabilization leg 108 as the beam 104 slides or otherwise transitions into the moving or compact positions. Other embodiments may utilize a crank/gear system that may couple a tongue jack to another jack located at the rear of the splitter 100. In embodiments, a common lead screw can be used to link the stands of each jack, which may allow movement of a beam 104 and/or crank to initiate movement of the stabilization leg 108 in a same or similar fashion as discussed previously. In some embodiments, an existing hydraulic system may be used to pressurize a cylinder, which may extend the stabilization leg 108. In such embodiments, a small line may bleed off of a pressurized line for pressurizing the cylinder and may be used to extend the stabilization leg. A spring return for the cylinder could also be employed to simplify the plumbing of the hydraulic system. Such embodiments may ensure that any time that the splitter is being used, the stabilization leg will be deployed. In other embodiments, a spring and/or pneumatic cylinder system may be used to deploy/retract the stabilization leg. Such embodiments may include a valve that is the same or similar to that used on band saws to control or stop the descent of the saw.

An automatically deployable and/or retractable stabilization leg 108 may provide the following benefits: prevent or reduce the likelihood that the splitter 100 tips over even if an operator of the splitter 100 forgets to deploy the stabilization leg 108; the operator of the splitter 100 may not have to crawl under the unit to deploy the stabilization leg 108 to split wood; the operator of the splitter 100 may not have to crawl under the unit to retract the stabilization leg 108 to move the unit; the stabilization leg 108 may not be damaged when the splitter 100 is being towed if the operator forgets to manually retract the stabilizer leg 108. It should be noted that having to crawl under the splitter 100 to retract the stabilization leg 108 could be relatively difficult or cumbersome if the operator has created a large pile of split firewood that has encompassed the stabilization leg 108.

As shown by FIG. 1C, the splitter 100 is in a moving position wherein an operator of the splitter 100 may manually move the splitter 100 to a new position and/or location. In some embodiments, the splitter 100 may be towed by a vehicle when the splitter 100 is in the moving position. In some embodiments, at least a portion of the beam 104 may be extended during towing and/or manual movement of the splitter 100. Although not shown by FIG. 1C, the stabilization leg 108 may be retracted prior to preparation for manual movement and/or towing. The transition from the extended position (or from the compact position) to the moving position may take place when the beam 104 is moved horizontally with respect to the tongue 105, the wheels 106, and/or the chassis of the splitter 100 to a position that is between the extended configuration and the compact configuration. In some embodiments, the tongue may be fixed to the chassis of the splitter 100. Additionally, the splitter 100 in the moving position may have an overall longitudinal length $D_m$ as measured from the hitch 120 to the footplate 116, which may be smaller or less than the overall longitudinal length $D_e$ of the splitter 100 in the extended position and greater than the longitudinal length $D_c$ of the splitter 100 in the compact position.

Splitter 100 may be placed in the moving position by moving the beam 104 towards the motor so that the weight and/or center of gravity of the splitter 100 is balanced over the wheels 106. Placing the weight of the splitter 100 over the wheels 106 may reduce the tongue weight to a quantity that is relatively manageable by an operator of the splitter 100, such as a tongue weight that is between approximately 40 pounds (lbs.) and approximately 60 lbs. In this way, the splitter 100 in the moving position may have an advantageous weight distribution. This advantageous weight distribution improves balance and stability of the splitter 100, which improves a user's ability to manually move the splitter 100. By contrast, typical log splitters may have a tongue weight that is approximately 80 lbs. A log splitter having an 80 lbs. tongue weight may be difficult to manually move without some difficulty.

Figure 2A:
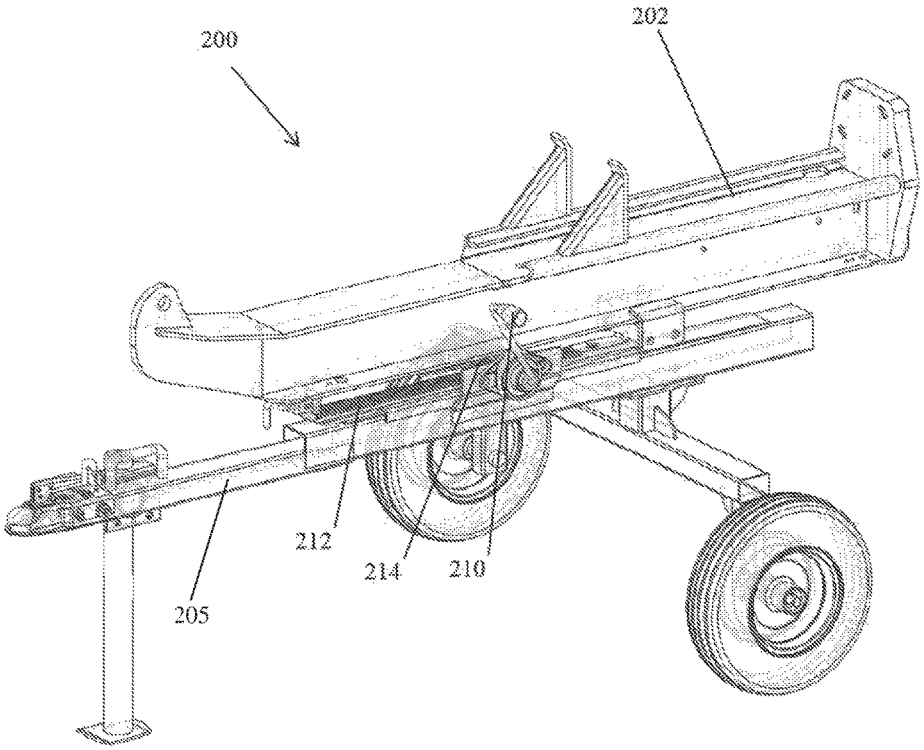
FIGS. 2A-2D illustrate various views of a splitter with an extendable work zone configured with a crank and an associated rack and pinion in accordance with various embodiments.
Figure 2B:
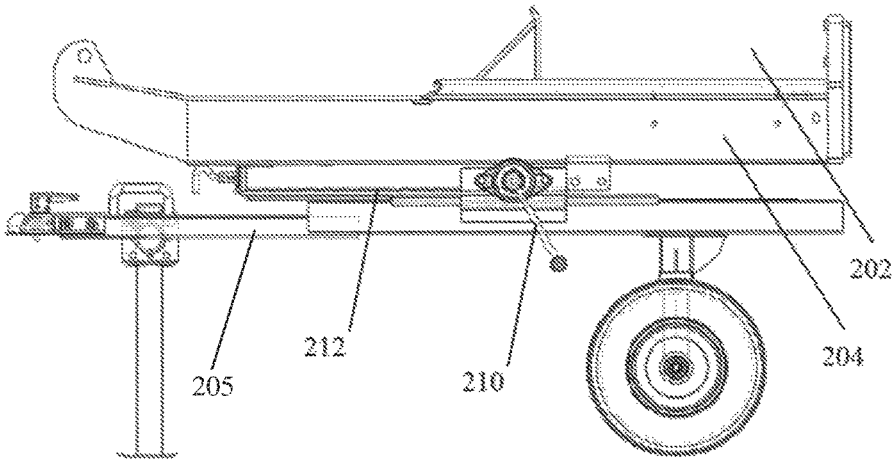
Figure 2C:
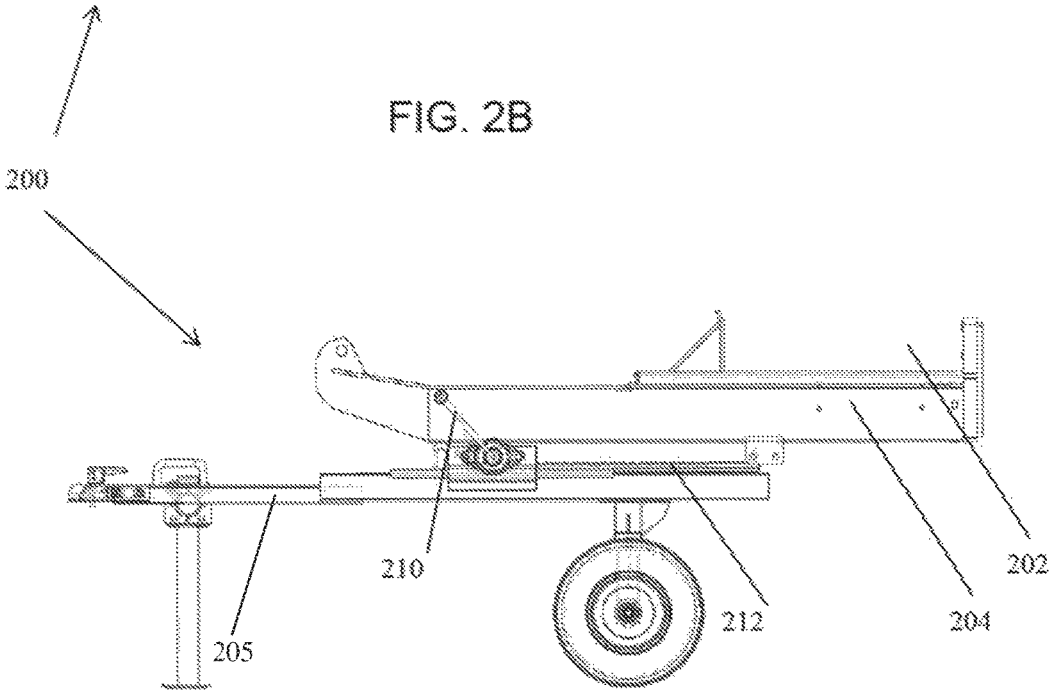

FIGS. 2A-2D illustrate various views of a splitter 200 with an extendable work zone 202 configured with a crank 210 and an associated rack 212 and pinion 214 in accordance with various embodiments. The splitter 200 also includes a beam 204 with a work zone 202, and the splitter 200 may split wood or logs in a same or similar manner as discussed previously with regard to splitter 100. Additionally, although not shown by FIGS. 2A-2D, the splitter 200 may include at least some of the same or similar components as discussed previously with regard to splitter 100. As shown by FIGS. 2A-2D, the rack 212 may be positioned on top of the tongue 205, and the crank 210 and pinion 214 may be positioned on a side of the splitter 200. However, in some embodiments, the crank 210 and an associated rack 212 and pinion 214 may be positioned in other configurations that are not shown by FIGS. 2A-2D. FIGS. 2A-2B show the splitter 200 in the compact position, and FIG. 2C shows the beam 204 extended to enhance the accessibility of the work zone 202. The actuation of crank 210 causes the movement of pinion 214 along rack 212 adjusting the location/extension of beam 204. In this way, actuation of the crank 210 may initiate the transition of the splitter 200 from the compact position to the moving position and/or the extended position, and vice versa.

Figure 2D:
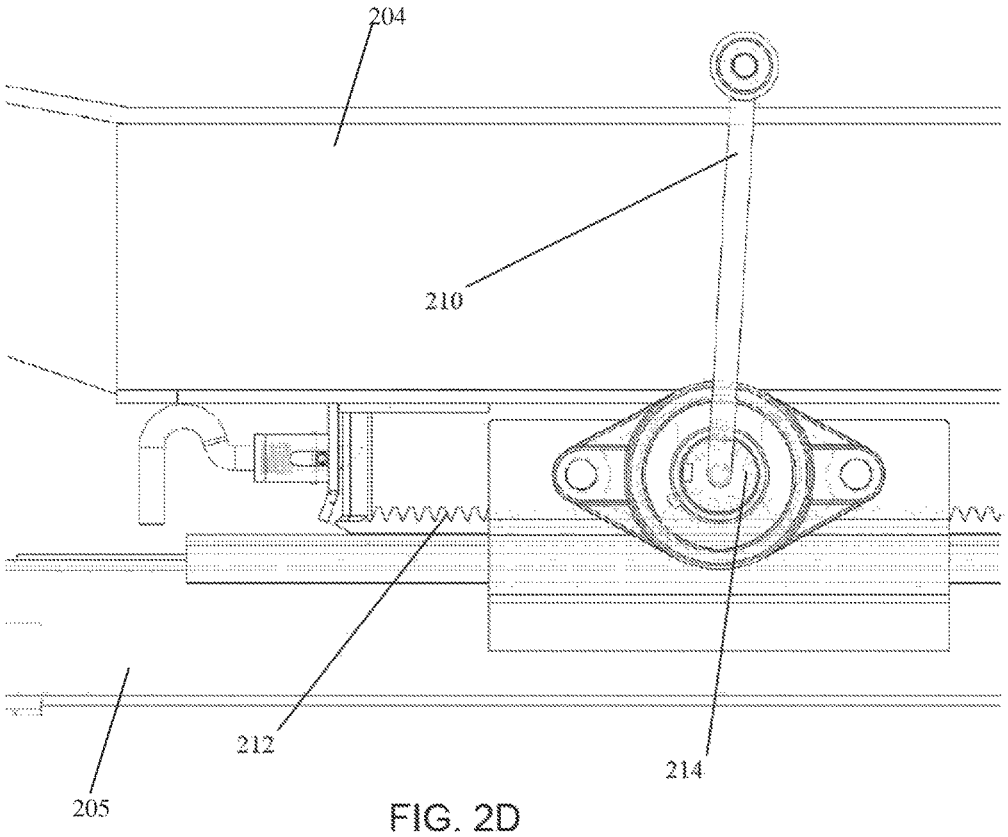

FIG. 2D provides a close-up of crank 210, rack 212, and pinion 214 (viewed through the base of crank 210). The pinion 214 may be a circular gear having teeth that engage teeth on the rack 212, wherein a rotational motion applied to the pinion 214 by way of the crank 210 causes the rack 212 to move relative to the pinion 214, thereby translating the rotational motion of the pinion 214 into linear motion of the beam 204 over the tongue 205. In embodiments, the crank 210 may be turned in one direction (for example, clockwise) to move the beam 204 over the tongue 205 in a first horizontal direction, and the crank 210 may be turned in an opposite direction (for example, anti-clockwise) to move the beam 204 over the tongue 205 in a second horizontal direction.

While a crank with associated rank and pinion are shown in FIGS. 2A-2D, various adjustment mechanisms may be used to move the beam 204 and/or work zone 202, including hydraulics, pneumatics, jack assemblies, slides, rails, worm gear assemblies, other rack and pinion arrangements and/or gear assemblies, and/or any other suitable mechanisms.

Figure 3:
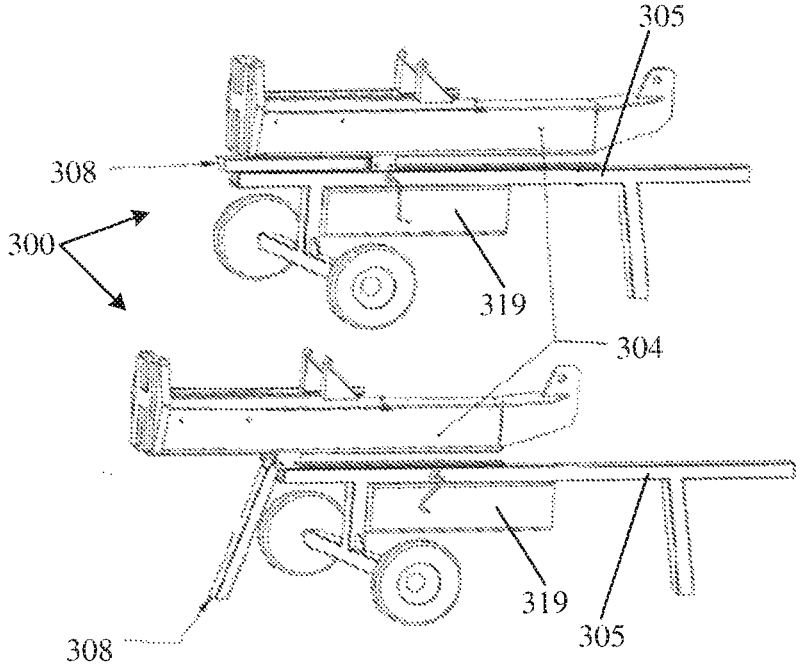
FIG. 3 illustrates a splitter with an extendable work zone and an associated support leg in accordance with various embodiments.

FIG. 3 illustrates a splitter 300 with an extendable work zone and an associated stabilization leg 308 in accordance with various embodiments. The splitter 300 may include the same or similar components as splitters 100-200 discussed previously with regard to FIGS. 1-2D. Additionally, the splitter 300 includes housing 319, which may include an engine, a pump, and/or a tank for hydraulic fluid. In various embodiments, the splitter 300 shown by FIG. 3 may include an automatically deployable and/or retractable stabilization leg 308 similar to the other stabilization legs as discussed herein. In embodiments, the stabilization leg 308 may be coupled with the beam 304 such that the stabilization leg 308 may retract with the beam 304. As shown, when the splitter 300 is in the compact position, the stabilization leg 308 may be parallel or substantially parallel with the beam 304 and/or the tongue 305. In such embodiments, the stabilization leg 308 may also extend with the beam 304 such that when the splitter 300 is in the extended position, the stabilization leg 308 may be deployed in order to stabilize the beam 304.

Figure 4:
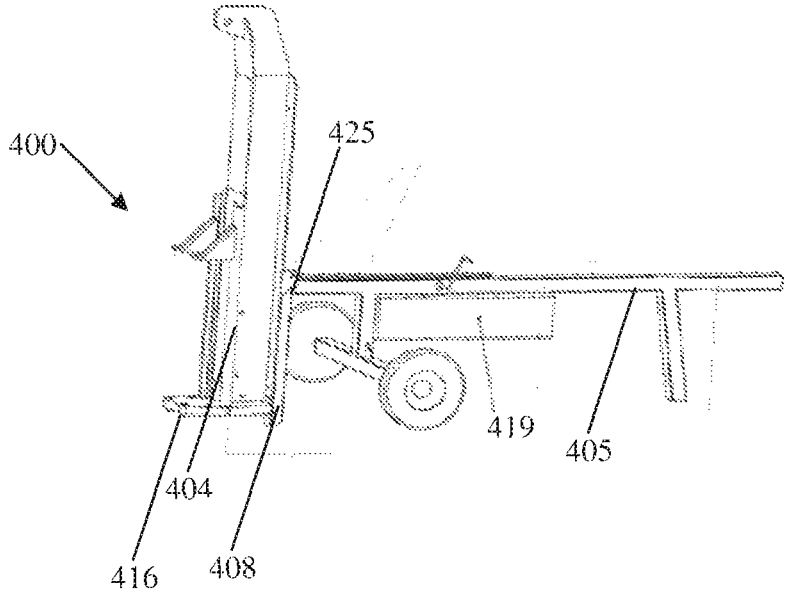
FIG. 4 illustrates a splitter in a vertical splitting configuration in accordance with various embodiments.

FIG. 4 illustrates a splitter 400 in a vertical splitting configuration (also referred to as a "vertical configuration," a "vertical splitting position," a "vertical position," and the like) in accordance with various embodiments. The splitter 400 may be the same or similar as splitter 300 discussed with regard to FIG. 3 in that splitter 400 may include the same or similar components as splitters 100-200 discussed previously with regard to FIGS. 1-2D. Furthermore, the splitter 400 may be operated in a same or similar fashion as splitters 100-300. The splitter 400 includes housing 419, which may include an engine, a pump, and/or a tank for hydraulic fluid. The splitter 400 may be configurable to be in the vertical position such that the beam 404 is perpendicular or substantially perpendicular to the tongue 405. In this regard, the splitter 400 may transition from the extended position to the vertical position by rotating the beam 404 about a hinge 425. The hinge 425 may be coupled with the stabilization leg 408 or the tongue 405. In some embodiments, the footplate 416 may have a stand built into it to allow the operator to better balance a relatively large log in the vertical position. Examples of such a stand are shown and described with regard to FIGS. 9A-9C. In the embodiment shown by FIG. 4, when the splitter 400 is in the vertical position, the beam 404 may rest on or otherwise may be adjacent to the stabilization leg 408. However, in other embodiments, the beam 404 may extend beyond the stabilization leg 408, or the stabilization leg 408 may be positioned closer to the wheels or chassis of the splitter 400 than shown by FIG. 4. In some embodiments, the housing 419 and/or an engine of the splitter 400 may be located closer to a hitch than the stabilization leg 408 in order to provide balance for the beam 404.

Figure 5A:
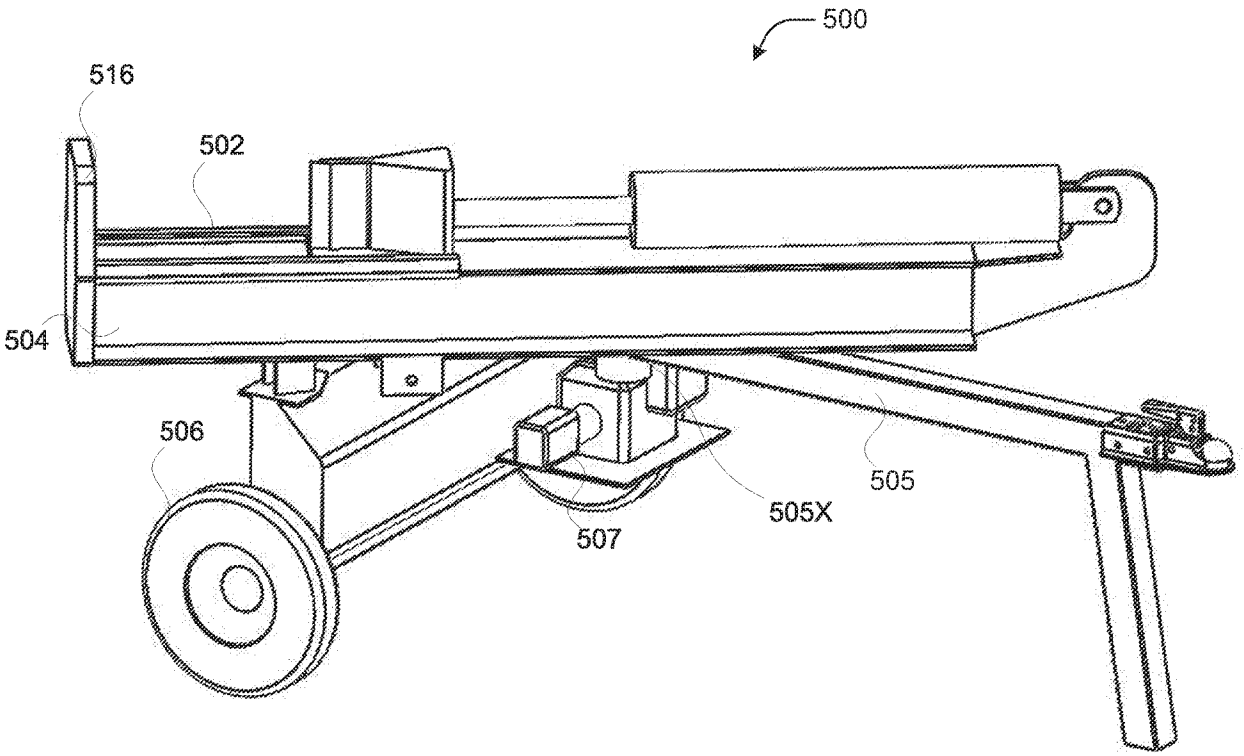
FIGS. 5A and 5B illustrate an alternative embodiment in which the splitter beam may be pivoted to alter the accessibility of the workspace in accordance with various embodiments.
Figure 5B:
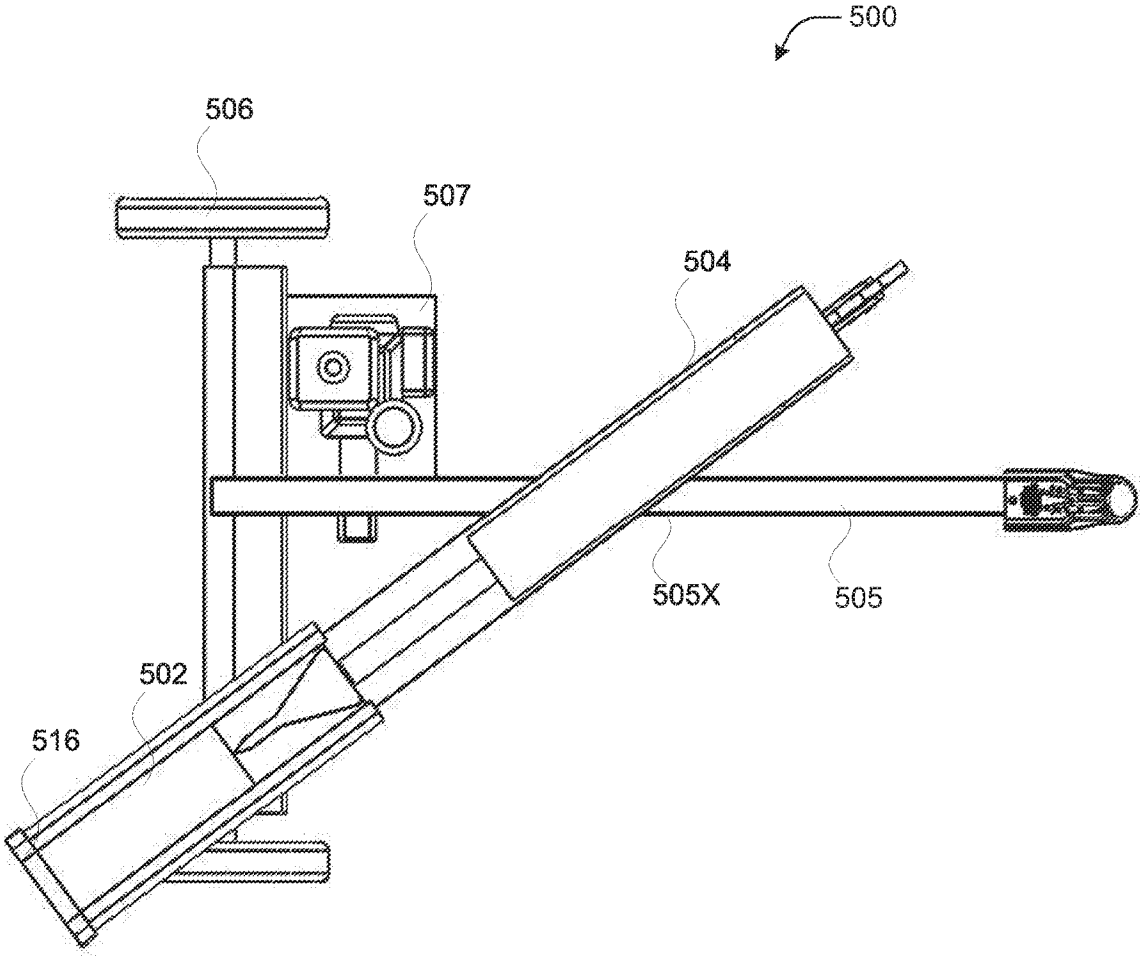

FIGS. 5A and 5B illustrate an alternative embodiment of a splitter 500 with an offset work zone 502, in accordance with various embodiments. Specifically, FIG. 5A shows a side view of the splitter 500, and FIG. 5B shows a top view of the splitter 500. As shown, the engine 507, fuel tank, etc., have been relocated to provide balance to the offset beam 504. The splitter 500 may split pieces of wood or logs in a same or similar fashion as splitters 100-400 discussed previously with regard to FIGS. 1-4, and although not shown, the splitter 500 may include at least some of the same or similar components as discussed previously with regard to splitters 100-400. In use, beam 504 may be pivoted or otherwise moved such that beam 504 is at an angle with respect to the tongue 505 in a horizontal plane, and may be returned to a centered position for storage, transport, and/or conversion to a vertical splitting configuration. A transition between the extended position to the offset configuration, and vice versa, may be achieved by moving beam 504 with respect to the tongue 505 about a pivot point 505X of the tongue 505. In the embodiment shown by FIGS. 5A-B, an operator of the splitter 500 may move an end of the beam 504 including the footplate 516 about the pivot point 505X. The splitter 500 in the offset position may increase access to the work zone 502 by limiting potential obstruction by the wheels 506 and/or engine 507. In some embodiments, the splitter 500 may be configurable to be in a vertical position (not shown). In such embodiments, the footplate 516 may have a stand built into it to allow the user to better balance a relatively large log in the vertical position and also serves as a flag to allow the user to see the unit when it is being towed.

Figure 6A:
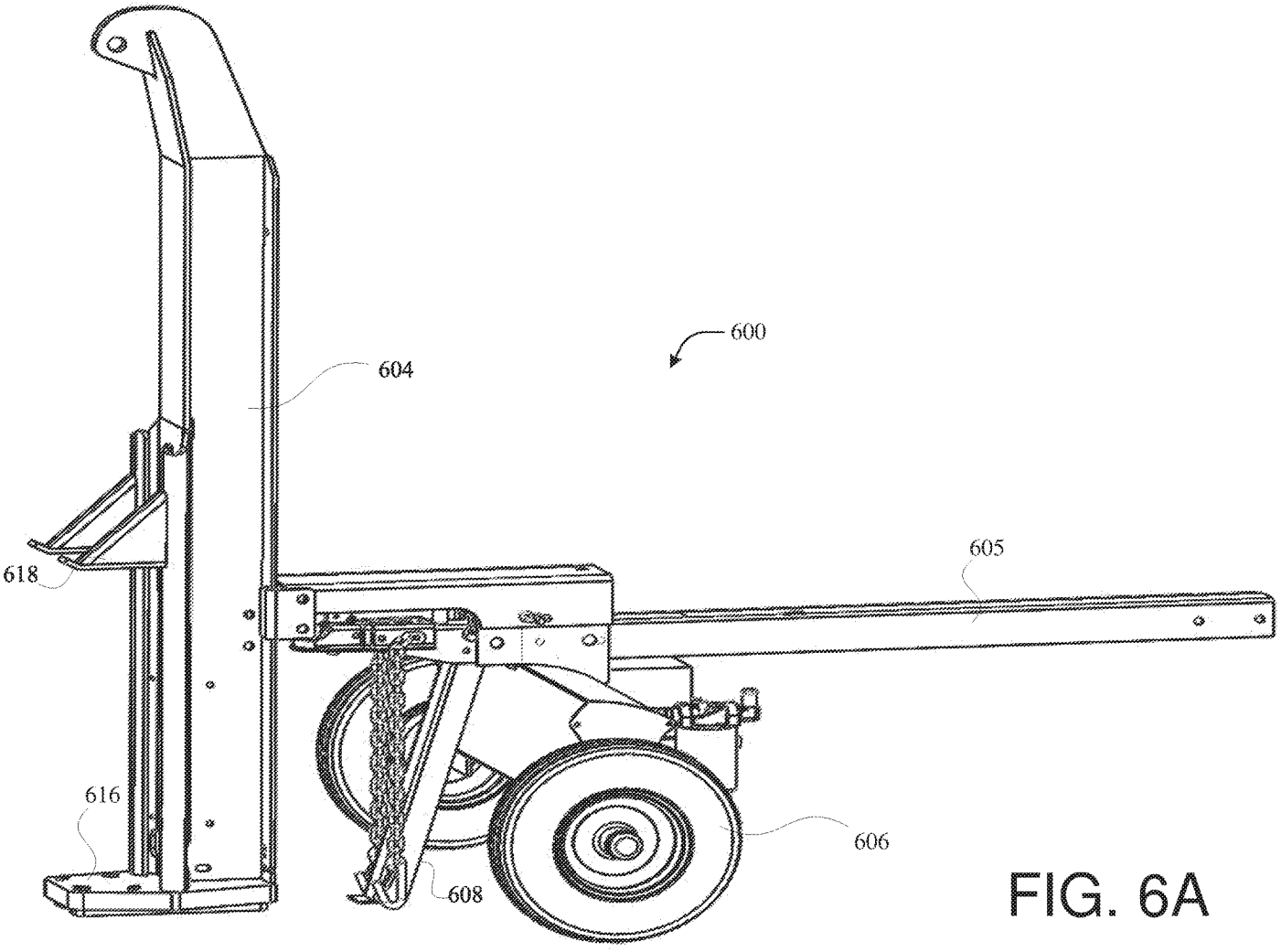
FIGS. 6A-6C illustrate a log splitter that may be placed in a vertical splitting configuration (FIG. 6A), a horizontal splitting configuration (FIG. 6B), and a towing configuration (FIG. 6C), respectively, in accordance with various embodiments.
Figure 6B:
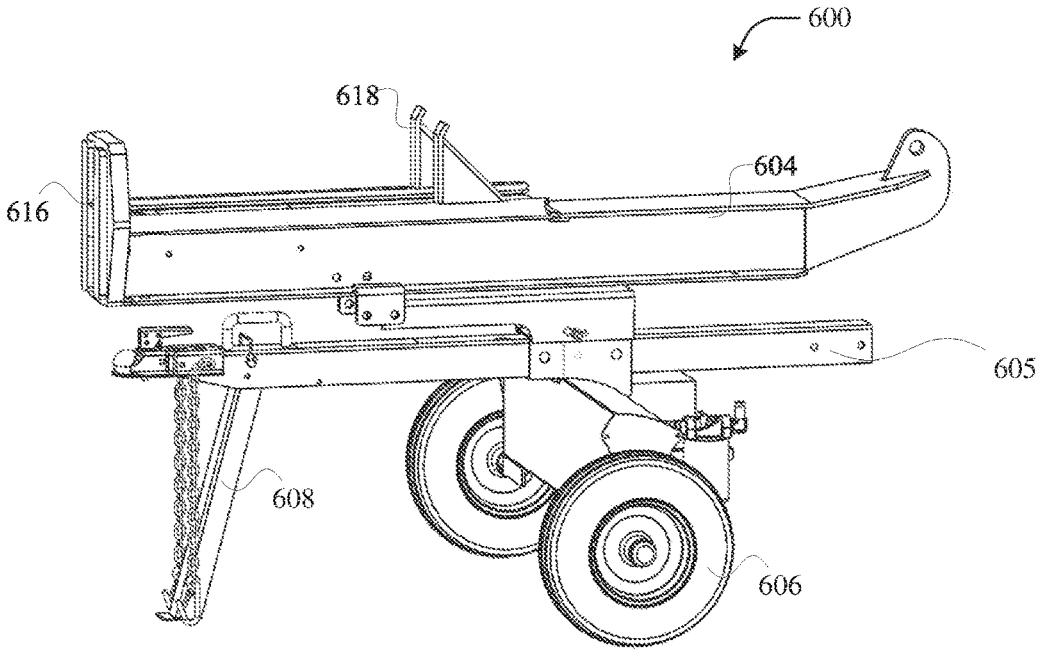
Figure 6C:
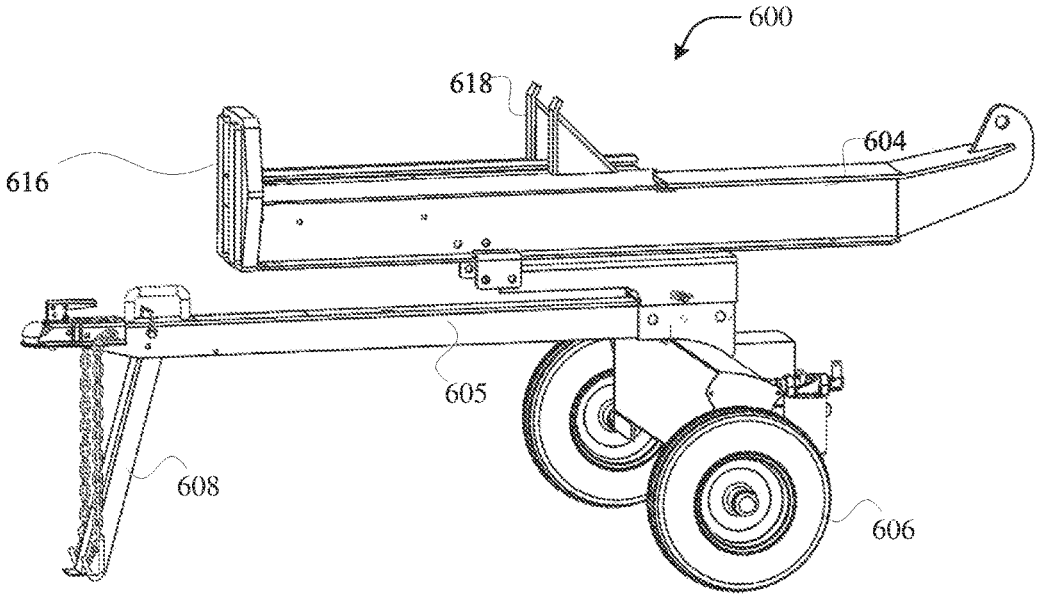

FIG. 6A illustrates a splitter 600 in a vertical splitting configuration (also referred to as a "vertical configuration," a "vertical splitting position," a "vertical position," and the like), in accordance with various embodiments, FIG. 6B illustrates the splitter 600 in a horizontal splitting configuration (also referred to as a "horizontal configuration," a "horizontal splitting position," a "horizontal position," and the like), in accordance with various embodiments, and FIG. 6C illustrates the splitter 600 in a towing configuration (also referred to as a "towing position," a "moving configuration," a "moving position," and the like), in accordance with various embodiments. The splitter 600 may split pieces of wood or logs in a same or similar fashion as splitters 100-500 discussed previously with regard to FIGS. 1-5. Although not shown, the splitter 600 may also include at least some of the same or similar components as discussed previously with regard to splitters 100-500.

The splitter 600 may provide an extended work space, and the splitter 600 may also be used in either a vertical or horizontal configuration. In contrast to the embodiments described elsewhere, a transition between the vertical position (FIG. 6A) to the horizontal position (FIG. 6B), and vice versa, may be achieved by sliding or otherwise moving a tongue 605 horizontally with respect to the beam 604 and/or the wheels 606 so that the beam 604 can be pivoted between the towing, horizontal, and vertical configurations. In such embodiments, the beam 604 may be fixed to the chassis of the splitter 600. In various embodiments, a tongue weight may also be controlled in order to allow an operator to tow the splitter 600 when the splitter is in the towing position or move the splitter 600 when the splitter is in the horizontal position or the vertical position. Further, in some embodiments, a stabilization leg, such as stabilization leg 608, may not be included with splitter 600 because the center of gravity of the splitter 600 with or without a log to be split may reside within a triangular support of the wheels 606 and the tongue 605. In some embodiments, the splitter 600 may also include a moving splitting device 618 and a fixed footplate 616 that may be the same or similar to the splitting devices and footplates discussed previously.

The splitter 600 includes a stabilization leg 608, which may be attached to the tongue 605. In some embodiments, the stabilization leg 608 may be arranged such that it attaches directly to the beam 604 or directly to a chassis of the splitter 600 rather than to the tongue 605 as shown in FIGS. 6A-6C. By directly connecting the support structure to the beam 604 or the chassis of the splitter 600, the tongue 605 may be removed or pushed out of the way during a splitting operation. In embodiments where the stabilization leg 608 is included with the splitter 600, placing the splitter 600 in the towing configuration may include retracting the stabilization leg prior to towing the splitter 600.

Figure 7A:
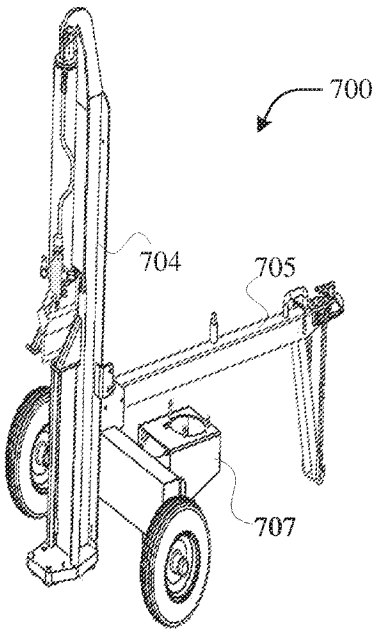
FIGS. 7A-7B illustrate a splitter that may be placed in a vertical splitting configuration (FIG. 7A), and a horizontal splitting configuration (FIG. 7B), respectively, in accordance with various other embodiments.
Figure 7B:
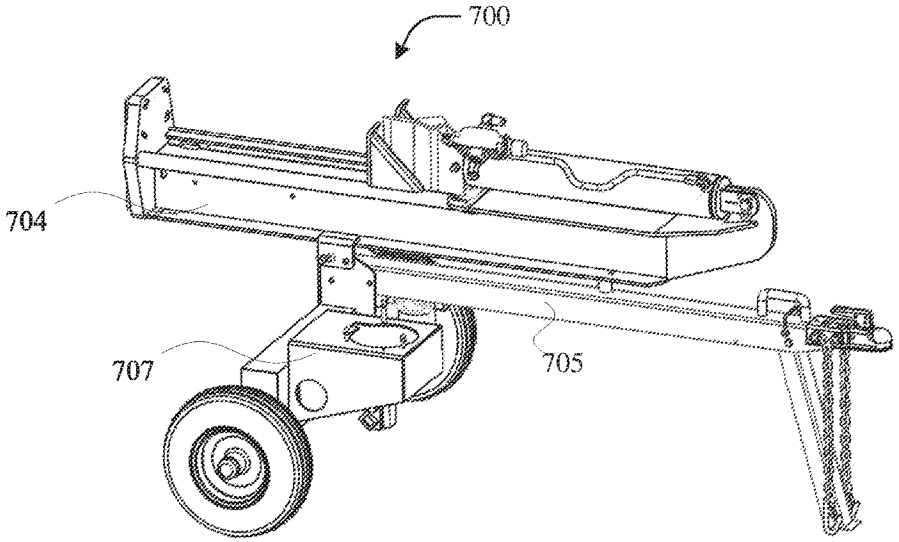

FIG. 7A illustrates another splitter 700 in a vertical splitting configuration in accordance with various embodiments, and FIG. 7B illustrates the splitter 700 of FIG. 7A in a horizontal splitting configuration in accordance with various embodiments. The splitter 700 may split pieces of wood or logs in a same or similar fashion as splitters 100-600 discussed previously with regard to FIGS. 1-6, and the splitter 700 may include at least some of the same or similar components as discussed previously with regard to splitters 100-600. In the embodiment shown by FIGS. 7A-B, the engine 707 may be positioned to the side of beam 704 rather than placed on an underside of tongue 705.

Figure 8:
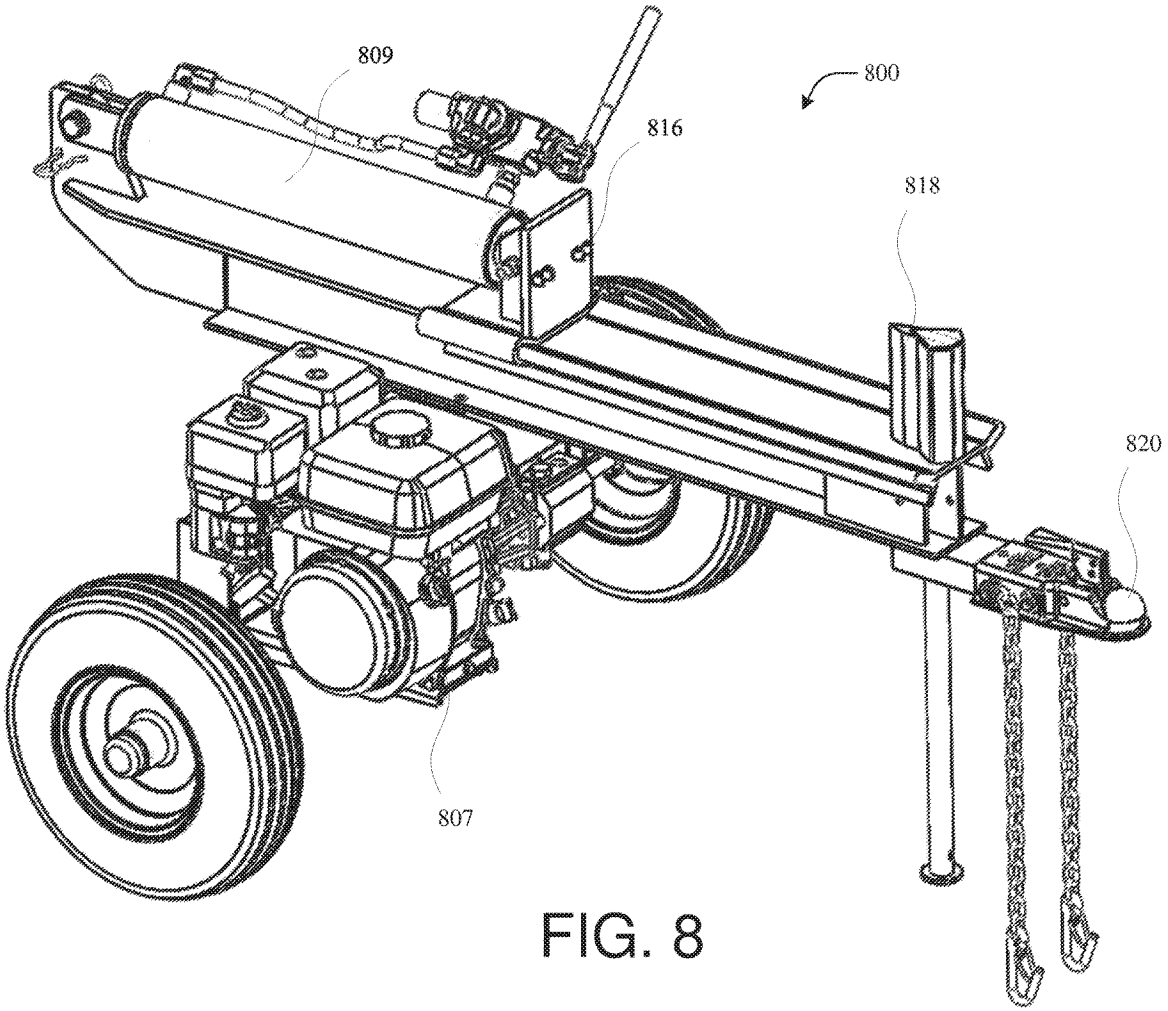
FIG. 8 illustrates a splitter in a reversed configuration, in accordance with various embodiments.

FIG. 8 illustrates a splitter 800 in a reversed configuration including a moving mechanism 809, a fixed splitting device 818, and a moving push plate 816. In such embodiments, the moving mechanism 809 and/or the push plate 816 may be located closer to an engine 807 of the splitter 800 than a hitch 820 of the splitter 800, and the push plate 816 may move toward the hitch 820 during a splitting operation. Although not shown, some embodiments of the splitter 800 in the reverse configuration may have a splitting device coupled with the moving mechanism 809 and a fixed plate that is similar to the footplates discussed previously. By contrast, in embodiments where the splitter is not in a reversed configuration, the push plate 816 (or moving splitting device) may move away from the hitch 820 during a splitting operation when the splitter 800 is in a horizontal position (for example, as shown by FIG. 7B) or move towards the ground during a splitting operation (for example, as shown by FIG. 7A) when the splitter is in a vertical position.

Figure 9C:
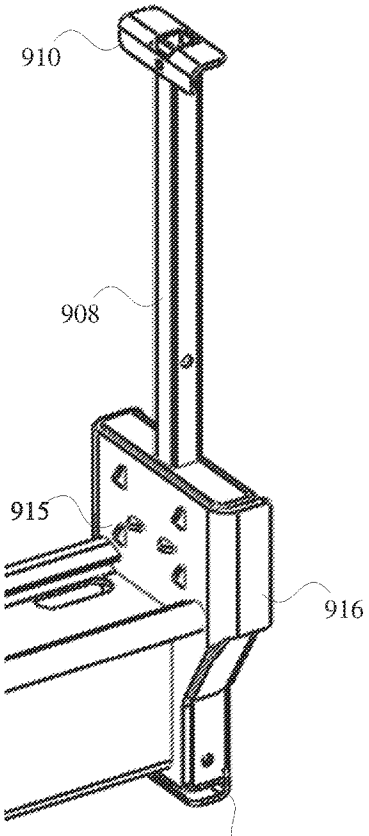
FIGS. 9A-9C illustrate a stabilization leg in a horizontal splitting position (FIG. 9A), a vertical splitting position (FIG. 9B), and a towing position (FIG. 9C), respectively, in accordance with various embodiments.
Figure 9B:
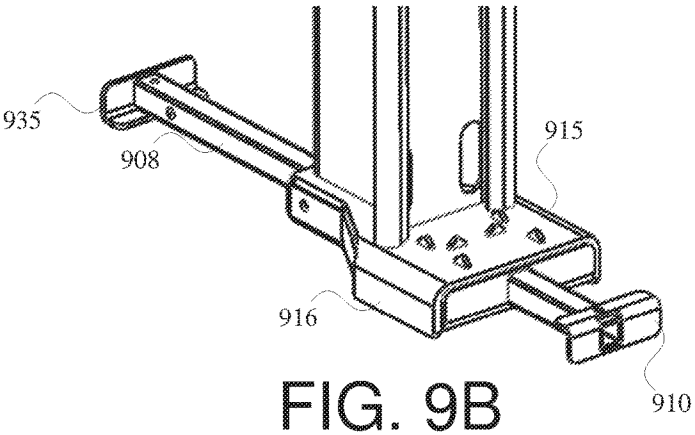
Figure 9A:
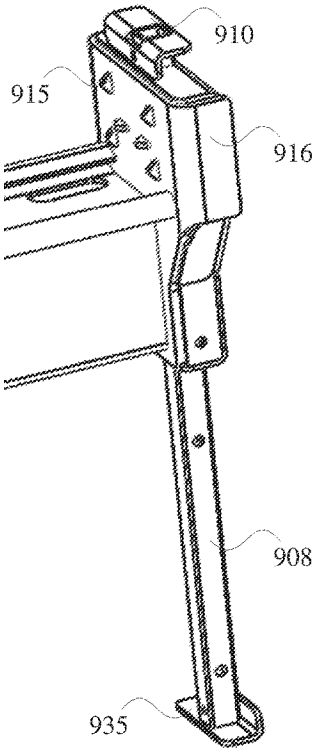

FIG. 9A illustrates a stabilization leg 908 in a horizontal splitting position in accordance with various embodiments, FIG. 9B illustrates the stabilization leg 908 in a vertical splitting position in accordance with various embodiments, and FIG. 9C illustrates the stabilization leg 908 in a towing position in accordance with various embodiments.

The stabilization leg 908 may provide stability for a log splitter, such as splitters 400-700 shown and described with regard to FIGS. 4-7B. The stabilization leg 908 may be incorporated into a top portion of the splitter. A log platform 915 may be an area of the footplate 916 that is used for placement of a log to be split. The stabilization leg 908 may provide additional functionality in that it may extend the log platform 915 of the footplate 916 when the splitter is used in the vertical splitting position, for example, as shown by FIGS. 6A and 7A. Extension of the log platform 915 may be accomplished by moving a top portion 910 away from the footplate 916 based on a diameter or circumference of a log to be split (FIG. 9B). For example, when the splitter is in the vertical splitting position, by sliding the top portion 910 away from the footplate 916, an area for holding logs may be extended to accommodate logs having relatively large diameter. Additionally, when the splitter is in the vertical splitting position, by sliding the top portion 910 towards from the footplate 916, an area for holding a log may be reduced to accommodate logs having relatively small diameters. The stabilization leg 908 could also extend upward when the unit is being towed to provide the top portion 910 as a flag or other like indicator to increase visibility while the unit is being towed (FIG. 9C). Additionally, the stabilization leg may include a base 935 to provide additional support for the splitter when the splitter is in the horizontal configuration (FIG. 9A). FIGS. 9A-9C illustrate one embodiment of a stabilization leg 908 that slides within the footplate 916. In such embodiments, the footplate 916 may include a channel or other like opening through which the stabilization leg 908 may slide to provide additional support for the splitter (FIG. 9A), hold a relatively wide log (FIG. 9B), or act as a flag or indicator during towing (FIG. 9C). In this way, when the splitter is in the vertical splitting position, the stabilization leg 908 may slide through the channel to adjust a size of the platform 915 in order to allow the footplate 916 to accommodate logs having varying diameters. For example, when the splitter is in the vertical splitting position, by sliding the top portion 910 away from the footplate 916, an area for holding logs may be extended to accommodate logs having relatively large diameter. Additionally, when the splitter is in the vertical splitting position, by sliding the top portion 910 towards from the footplate 916, an area for holding a log may be reduced to accommodate logs having relatively small diameters. In other embodiments, the stand or stabilization leg may be designed such that the stabilization leg pivots or flips around the footplate 916.

Some non-limiting examples are as follows:

Example 1 may include a log splitter comprising a tongue and a beam moveably coupled with the tongue. The log splitter is configurable to be in at least one of an extended position or a compact position via movement of the beam with respect to the tongue. An overall longitudinal length of the log splitter in the compact position is smaller than an overall longitudinal length of the log splitter in the extended position.

Example 2 may include the log splitter of example 1 and/or one or more other examples herein, further comprising a stabilization leg to stabilize the log splitter when the log splitter is in the extended position. The stabilization leg is to be deployed at least when the log splitter is in the extended position.

Example 3 may include the log splitter of example 2 and/or one or more other examples herein, wherein, when deployed, the stabilization leg is at a (approximate) right angle with respect to the tongue or the stabilization leg is at an obtuse angle with respect to the tongue.

Example 4 may include the log splitter of example 2 and/or one or more other examples herein, wherein a first transition from the extended position to the compact position is initiated by a first horizontal movement of the beam in a first direction with respect to the tongue and a second transition from the compact position to the extended position is initiated by a second horizontal movement of the beam in a second direction with respect to the tongue. The first direction is an opposite direction of the second direction.

Example 5 may include the log splitter of example 4 and/or one or more other examples herein, wherein the stabilization leg is to automatically deploy when the log splitter transitions from the compact position to the extended position, and the stabilization leg is to automatically retract when the log splitter transitions from the extended position to the compact position.

Example 6 may include the log splitter of example 5 and/or one or more other examples herein, wherein the stabilization leg is coupled with the beam such that the automatic retraction of the stabilization leg includes a retraction movement to retract the stabilization leg that corresponds with the movement of the beam in the first direction, and the automatic deployment of the stabilization leg includes a deployment movement to deploy the stabilization leg that corresponds with the movement of the beam in the second direction.

Example 7 may include the log splitter of example 4 and/or one or more other examples herein, further comprising a crank and an associated rack and pinion. Actuation of the crank is to cause movement of the pinion along the rack to initiate movement of the beam in the first direction or in the second direction. The crank can be turned or actuated in another first direction to cause the movement of the pinion along the rack to initiate movement of the beam in the first direction, and the crank can be turned or actuated in another second direction to cause the movement of the pinion along the rack to initiate movement of the beam in the second direction.

Example 8 may include the log splitter of example 7 and/or one or more other examples herein, wherein the actuation of the crank is to cause deployment or retraction of the stabilization leg in correspondence with movement of the beam in the first direction or the second direction.

Example 9 may include the log splitter of example 1 and/or one or more other examples herein, wherein the beam comprises a work zone to hold a log or round of wood to be split. The work zone includes a splitting device and a footplate. The splitting device is moveable towards the footplate to split the log or round of wood held in the work zone or the footplate is moveable towards the splitting device to split the log or round of wood held in the work zone.

Example 10 may include the log splitter of example 2 and/or one or more other examples herein, wherein the log splitter is further configurable to be in a moving position. The log splitter in the moving position has an overall longitudinal length that is less than the overall longitudinal length of the log splitter in the extended position and greater than the overall longitudinal length of the log splitter in the compact position. Further, at least a portion of the beam is extended when the log splitter is in the moving position, as compared to a position of the beam when the log splitter in the compact position.

Example 11 may include the log splitter of example 10 and/or one or more other examples herein, further comprising a set of wheels. A center of gravity of the log splitter is balanced over the set of wheels when the log splitter is in the moving position.

Example 12 may include the log splitter of example 11 and/or one or more other examples herein, wherein when the log splitter is in the moving position, a tongue weight of the log splitter is between approximately 40 pounds (lbs.) and approximately 60 lbs.

Example 13 may include the log splitter of example 2 and/or one or more other examples herein, wherein the log splitter is further configurable to be in a vertical position. In the vertical position, the beam is substantially perpendicular to the tongue. A transition from the extended position to the vertical position is initiated by rotation of the beam about a hinge coupled with the tongue.

Example 14 may include the log splitter of example 13 and/or one or more other examples herein, wherein in the vertical position, the beam is adjacent to the stabilization leg.

Example 15 may include the log splitter of example 1 and/or one or more other examples herein, wherein the log splitter is further configurable to be in an offset position. In the offset position, the beam is at an angle with respect to the tongue. A transition from the extended position to the offset position is initiated by movement of the beam about a pivot point of the tongue.

Example 16 may include the log splitter of example 15 and/or one or more other examples herein, wherein the beam includes a splitting device and a footplate, and the log splitter further comprises an engine to power a moving mechanism coupled with the splitting device. The transition from the extended position to the offset position is initiated by movement of an end of the beam including the footplate about the pivot point away from the engine.

Example 17 may include the log splitter of example 1 and/or one or more other examples herein, wherein a first transition from the extended position to the compact position is initiated by movement of the tongue in a first direction with respect to the beam, and a second transition from the compact position to the extended position is initiated by movement of the tongue in a second direction with respect to the beam, wherein the first direction is an opposite direction of the second direction.

Example 18 may include a log splitter that is configurable to be in one of a horizontal splitting position and a vertical splitting position. The log splitter comprises a footplate moveably coupled with a stabilization leg. When the log splitter is in the vertical splitting position, the footplate is to hold a log to be split. When the log splitter is in the horizontal splitting position, the stabilization leg is to stabilize the log splitter.

Example 19 may include the log splitter of example 18 and/or one or more other examples herein, wherein the stabilization leg comprises a base at a first end of the stabilization leg and a top portion at a second end of the stabilization leg. The base is to stabilize the log splitter when the log splitter is in the horizontal splitting position, and the top portion is a portion of the stabilization leg to hold the log with the footplate when the log splitter is in the vertical splitting position.

Example 20 may include the log splitter of example 19 and/or one or more other examples herein, wherein the log splitter is further configurable to be in a towing position, and when the log splitter is in the towing position, the top portion is to be extended away from the footplate.

Example 21 may include the log splitter of example 18 and/or one or more other examples herein, wherein the footplate comprises a channel through which the stabilization leg is to slide. The stabilization leg is to slide through the channel to adjust a size of a platform of the footplate for holding logs in order to accommodate logs having varying diameters.

Example 22 may include a log splitter configurable between a first position and a second position, and the log splitter comprises a stabilization leg including a mechanism to automatically deploy the stabilization leg during a first movement into the first position from the second position. The mechanism may automatically retract the stabilization leg during a second movement into the second position from the first position.

Example 23 may include the log splitter of example 22 and/or one or more other examples herein, wherein the mechanism is one or more of a sliding mechanism, a rack and pinion gear system, a rack and worm gear system, a hydraulic system, or a pneumatic system.

Example 24 may include the log splitter of example 22 and/or one or more other examples herein, wherein the log splitter further comprises a beam and a tongue. The beam is moveably coupled with the tongue, and movement of the beam with respect to the tongue in a first direction corresponds to the first movement into the first position and movement of the beam with respect to the tongue in a second direction corresponds to the second movement into the second position, wherein the first direction is an opposite direction of the second direction. Additionally, the mechanism is a sliding mechanism.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

We claim:

1. A log splitter comprising:

a tongue;

a beam moveably coupled with the tongue, wherein the log splitter is configurable to be in at least one of an extended position or a compact position via movement of the beam with respect to the tongue, and wherein an overall longitudinal length of the log splitter in the compact position is smaller than an overall longitudinal length of the log splitter in the extended position;

a stabilization leg to stabilize the log splitter when the log splitter is in the extended position, wherein the stabilization leg is to be deployed at least when the log splitter is in the extended position, wherein a first transition from the extended position to the compact position is initiated by a first horizontal movement of the beam in a first direction with respect to the tongue, and a second transition from the compact position to the extended position is initiated by a second horizontal movement of the beam in a second direction with respect to the tongue, wherein the first direction is an opposite direction of the second direction, and a crank and an associated rack and pinion, wherein actuation of the crank is to cause movement of the pinion along the rack to initiate movement of the beam in the first direction or in the second direction.

2. The log splitter of claim 1, wherein the actuation of the crank is to cause deployment or retraction of the stabilization leg in correspondence with movement of the beam in the first direction or the second direction.

3. A log splitter configurable to be in one of a horizontal splitting position and a vertical splitting position, the log splitter comprising:

a footplate coupled with a stabilization leg, wherein, when the log splitter is in the vertical splitting position, the footplate is to hold a log to be split, and wherein, when the log splitter is in the horizontal splitting position, the stabilization leg is to stabilize the log splitter, and wherein the footplate comprises a channel through which the stabilization leg is to slide.

* * * * *